US009026026B2

(12) United States Patent
Jeong et al.

(10) Patent No.: US 9,026,026 B2
(45) Date of Patent: May 5, 2015

(54) CLEANING BLADES, CLEANING UNITS, ELECTROPHOTOGRAPHIC IMAGING APPARATUSES AND ELECTROPHOTOGRAPHIC CARTRIDGES EMPLOYING THE SAME

(71) Applicant: Samsung Electronics Co., Ltd, Suwon-si, Gyeonggi-do (KR)

(72) Inventors: Soon-cheol Jeong, Seoul (KR); Cha-young Bae, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 13/944,253

(22) Filed: Jul. 17, 2013

(65) Prior Publication Data

US 2014/0153987 A1 Jun. 5, 2014

(30) Foreign Application Priority Data

Nov. 30, 2012 (KR) ..... 10-2012-0138503

(51) Int. Cl.
*G03G 21/00* (2006.01)

(52) U.S. Cl.
CPC ..... *G03G 21/0011* (2013.01); *G03G 21/0017* (2013.01)

(58) Field of Classification Search
USPC ..... 399/350, 351
See application file for complete search history.

(56) References Cited

U.S. PATENT DOCUMENTS

| | | | | |
|---|---|---|---|---|
| 4,521,582 | A * | 6/1985 | Goyert et al. | 528/67 |
| 5,270,518 | A * | 12/1993 | Naoumenko et al. | 219/203 |
| 5,481,985 | A * | 1/1996 | Lin et al. | 105/199.4 |
| 5,510,887 | A * | 4/1996 | Watabe et al. | 399/350 |
| 5,555,817 | A * | 9/1996 | Taillon et al. | 105/198.2 |
| 6,128,462 | A * | 10/2000 | Kato et al. | 399/350 |
| 2001/0025079 | A1* | 9/2001 | Weigl et al. | 524/500 |
| 2002/0021923 | A1* | 2/2002 | Sato et al. | 399/350 |
| 2002/0041779 | A1* | 4/2002 | Hisakuni | 399/350 |
| 2002/0127036 | A1* | 9/2002 | Sato et al. | 399/350 |
| 2004/0029987 | A1* | 2/2004 | Sawai | 521/155 |
| 2004/0240915 | A1* | 12/2004 | Nakayama | 399/345 |
| 2007/0148471 | A1* | 6/2007 | Rukavina et al. | 428/423.1 |
| 2007/0149747 | A1* | 6/2007 | Rukavina et al. | 528/44 |
| 2007/0256597 | A1* | 11/2007 | Rukavina et al. | 106/287.25 |
| 2009/0010984 | A1* | 1/2009 | Levy et al. | 424/422 |
| 2009/0068479 | A1* | 3/2009 | Konstanzer et al. | 428/457 |
| 2009/0280329 | A1* | 11/2009 | Rukavina et al. | 428/412 |
| 2009/0280709 | A1* | 11/2009 | Rukavina et al. | 442/394 |
| 2009/0281268 | A1* | 11/2009 | Rukavina et al. | 528/60 |
| 2010/0031466 | A1* | 2/2010 | Abe et al. | 15/256.5 |
| 2010/0087561 | A1* | 4/2010 | Abraham et al. | 521/170 |
| 2010/0124649 | A1* | 5/2010 | Rukavina et al. | 428/292.1 |
| 2012/0021853 | A1* | 1/2012 | Tarao et al. | 473/374 |

* cited by examiner

*Primary Examiner* — David Bolduc
(74) *Attorney, Agent, or Firm* — Staas & Halsey LLP

(57) ABSTRACT

A cleaning blade to remove a residual toner present on a surface of an electrophotographic photoreceptor, a cleaning unit, an electrophotographic imaging apparatus, and an electrophotographic cartridge including the cleaning blade.

9 Claims, 1 Drawing Sheet

CLEANING BLADES, CLEANING UNITS, ELECTROPHOTOGRAPHIC IMAGING APPARATUSES AND ELECTROPHOTOGRAPHIC CARTRIDGES EMPLOYING THE SAME

CROSS-REFERENCE TO RELATED APPLICATIONS

This application claims the priority under 35 U.S.C. §119 from Korean Patent Application No. 12-2012-0138503, filed on Nov. 30, 2012, in the Korean Intellectual Property Office, the disclosure of which is incorporated herein in its entirety by reference.

BACKGROUND OF THE INVENTION

1. Field of the Invention

The present general inventive concept relates to cleaning blades and cleaning units, electrophotographic imaging apparatuses, and electrophotographic cartridges employing the cleaning blades. More specifically, the present general inventive concept relates to cleaning blades having excellent cleaning performance and durability, cleaning units, electrophotographic imaging apparatuses and electrophotographic cartridges employing the cleaning blades.

2. Description of the Related Art

Electrophotographic apparatuses used in facsimiles, laser printers, photocopiers and the like produce toned images by using methods described below, for example. First, a surface of the photosensitive layer of an electrophotographic photoreceptor is uniformly and electrostatically charged, and then the charged surface is exposed to a pattern of light, thus forming a latent image. The light exposure selectively dissipates the charge in the exposed regions where the light strikes the surface, thereby forming a pattern of charged and uncharged regions, which is referred to as a latent image. Thereafter, a toner is provided in a vicinity of the latent image during development, and the toner gets charged due to tribocharging by a toner layer regulating blade made of stainless steel to control a toner layer or injection charging. The charged toner then attaches to uncharged regions to produce a toned image on the surface of the photosensitive layer. The resulting toned image is electrostatically transferred to a suitable final or intermediate receiving surface, such as paper, or the photosensitive layer may function as a final receptor to receive the image. Thereafter, the toned image transferred to the final or the intermediate image-receiving surface passes through a fixing process.

Recently, a demand for high quality images with respect to electrophotography has been rapidly increasing. As a measure for achieving high quality images in electrophotography, a small diameter toner, for example about 5 to about 6 μm, having a shape close to a perfect sphericity (sphericity in a range of about 0.976 to about 0.985 when measured by using a flow particle image analyzer (FPIA)) has been widely used. Due to the small diameter of the toner, the importance of a cleaning technology to remove a residual toner from a photosensitive layer and to remove external additives and other additives is increasing. This is because, as the diameter of the toner decreases, cleaning becomes more difficult and may easily lead to a defective image due to residual toner remaining on the photosensitive layer after cleaning.

In order to improve cleaning performances under a low temperature and low humidity condition (a L/L condition), a conventional cleaning method generally uses a method of controlling properties of the cleaning blade such that a peak value of loss tangent, i.e., a peak value of the so-called tan δ, obtained by measuring a dynamic viscoelasticity of the cleaning blade is located in the vicinity of a lowest possible temperature in which an imaging apparatus having the cleaning blade may be used. However, a low temperature cleaning performance demanded by consumers of a cleaning blade is difficult to be satisfied due to a decrease in rubber characteristics and property changes resulting from storage at a low temperature and climate conditions experienced during transportation of a product. Specifically, storage and operation of a cleaning blade in a temperature range of about −5° C. to about 0° C. may result in cleaning defects. In particular, according to the conventional cleaning method, when temperatures representing the peak tan δ value of any two cleaning blades are assumed to be identical, abrasion resistance and durability of the cleaning blades may greatly change depending on a shear modulus G* value at that temperature, and, as a result, the cleaning blades prepared to have improved cleaning performances under a L/L condition according to the conventional cleaning method are disadvantageous in obtaining good high temperature cleaning performances. Accordingly, the use of a conventional cleaning blade is difficult to implement in response to a rising demand for high operational speed and high durability of electrophotographic imaging apparatuses. In a low temperature environment, the conventional cleaning blade has low elasticity, resulting in a poor cleaning performance. The same conventional cleaning blade has sufficient elasticity in a high temperature environment, maintaining efficiency of a cleaning performance; however, problems such as cracking, poor abrasion resistance and poor durability occur. Specifically, in an L/L condition, a rebound resilience of a polyurethane rubber cleaning blade is highly temperature dependent and the value thereof decreases as a temperature decreases. In this regard, a primary mechanism of the cleaning blade to remove a residual toner under the L/L condition becomes difficult to obtain. Specifically, it becomes difficult for a stick-slip phenomenon of the edge portion of a cleaning blade to occur under the L/L condition, decreasing the cleaning performance under the L/L condition. On the contrary, if the rebound resilience of the polyurethane rubber cleaning blade is increased, the cleaning performance improves, but at the expense of a decreased modulus and a decreased mechanical strength of the polyurethane rubber. In addition, under a high temperature and high humidity condition (a H/H condition), an edge crack may easily occur in a polyurethane rubber cleaning blade having a small modulus because of an increased coefficient of friction between a photoreceptor surface and the cleaning blade.

SUMMARY OF THE INVENTION

The present general inventive concept provides cleaning blades having excellent cleaning performance in low temperature environments and excellent abrasion resistance and durability at in high temperature environments.

The present general inventive concept also provides cleaning units employing the cleaning blades.

The present general inventive concept also provides electrophotographic imaging apparatuses employing the cleaning blades.

The present general inventive concept also provides electrophotographic cartridges employing the cleaning blades.

Additional features and utilities of the present general inventive concept will be set forth in part in the description which follows and, in part, will be obvious from the description, or may be learned by practice of the general inventive concept.

Exemplary embodiments of the present general inventive concept provide a cleaning blade to remove a residual toner present on a surface of an electrophotographic photoreceptor, wherein a value of the shear modulus of the cleaning blade over the change in a temperature range of about −5° C. to about 23° C. and a value of the shear modulus at a temperature of −5° C. of the cleaning blade obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the conditions of $0.292 \leq \Delta G^*(MPa)/\Delta T(^\circ C.) \leq 0.490$, $24.7 \leq G^*(MPa)@-5^\circ C. \leq 32.4$, and wherein $\Delta G^*(MPa)/\Delta T(^\circ C.)$ is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

A value of the shear modulus at a temperature of 23° C. further satisfies the condition of $9.3 \leq G^*(MPa)@23^\circ C. \leq 14.6$, and wherein G*(MPa)@23° C. is a shear modulus value (unit: MPa) at the temperature of 23° C.

The cleaning blade may include a polyurethane.

Exemplary embodiments of the present general inventive concept also provide a cleaning unit to remove a residual toner present on a surface of an electrophotographic photoreceptor, the unit including a cleaning blade, and a supporting member to support the cleaning blade by attaching to at least one part of the cleaning blade, wherein the cleaning blade removes the residual toner present on the surface of the electrophotographic photoreceptor, wherein a value of the shear modulus of the cleaning blade over the change in a temperature range of about −5° C. to about 23° C. and a value of the shear modulus at a temperature of −5° C. of the cleaning blade obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the conditions of $0.292 \leq \Delta G^*(MPa)/\Delta T(^\circ C.) \leq 0.490$, $24.7 \leq G^*(MPa)@-5^\circ C. \leq 32.4$, and wherein $\Delta G^*(MPa)/\Delta T(^\circ C.)$ is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

A value of the shear modulus of the cleaning blade at a temperature of 23° C. further satisfies the condition of $9.3 \leq G^*(MPa)@23^\circ \leq C. \leq 14.6$, and wherein G*(MPa)@23° C. is a shear modulus value (unit: MPa) at the temperature of 23° C.

The cleaning blade may include a polyurethane.

Exemplary embodiments of the present general inventive concept also provide an electrophotographic imaging apparatus including an electrophotographic photoreceptor, a charging apparatus to charge the electrophotographic photoreceptor by contacting the electrophotographic photoreceptor, an exposure apparatus to form an electrostatic latent image on a surface of the electrophotographic photoreceptor, a developing apparatus to produce a visible image by developing the electrostatic latent image, a transfer apparatus to transfer the visible image onto an image-receiving member, and a cleaning unit to remove a residual toner present on the surface of the electrophotographic photoreceptor, wherein the cleaning unit includes a cleaning blade, and a supporting member to support the cleaning blade by attaching to at least one part of the cleaning blade, wherein the cleaning blade removes the residual toner present on the surface of the electrophotographic photoreceptor, wherein a value of the shear modulus of the cleaning blade over the change in a temperature range of about −5° C. to about 23° C. and a value of the shear modulus at a temperature of −5° C. of the cleaning blade obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the conditions of $0.292 \leq \Delta G^*(MPa)/\Delta T(^\circ C.) \leq 0.490$, $24.7 \leq G^*(MPa)@-5^\circ C. \leq 32.4$, and wherein $\Delta G^*(MPa)/\Delta T(^\circ C.)$ is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

A value of the shear modulus of the cleaning blade at a temperature of 23° C. further satisfies the condition of $9.3 \leq G^*(MPa)@23^\circ C. \leq 14.6$, and wherein G*(MPa)@23° C. is a shear modulus value (unit: MPa) at the temperature of 23° C.

The cleaning blade may include a polyurethane.

Exemplary embodiments of the present general inventive concept also provide an electrophotographic cartridge including an electrophotographic photoreceptor, and a cleaning unit to remove a residual toner present on a surface of the electrophotographic photoreceptor after a visible image formed thereon having been transferred onto an image-receiving member, wherein the electrophotographic cartridge supports the electrophotographic photoreceptor and the cleaning unit, and the electrophotographic cartridge is attachable to the electrophotographic imaging apparatus and the electrophotographic cartridge is detachable from the electrophotographic imaging apparatus, wherein the cleaning unit includes a cleaning blade, a supporting member to support the cleaning blade by attaching to at least one part of the cleaning blade, wherein the cleaning blade removes the residual toner present on the surface of the electrophotographic photoreceptor, wherein a value of the shear modulus of the cleaning blade over the change in a temperature range of about −5° C. to about 23° C. and a value of the shear modulus at a temperature of −5° C. of the cleaning blade obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the conditions of $0.292 \leq \Delta G^*(MPa)/\Delta T(^\circ C.) \leq 0.490$, $24.7 \leq G^*(MPa)@-5^\circ C. \leq 32.4$, and wherein $\Delta G^*(MPa)/\Delta T(^\circ C.)$ is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

A value of the shear modulus of the cleaning blade at a temperature of 23° C. further satisfies the condition of $9.3 \leq G^*(MPa)@23^\circ C. \leq 14.6$, and wherein G*(MPa)@23° C. is a shear modulus value (unit: MPa) at the temperature of 23° C.

The cleaning blade may include a polyurethane.

The polyurethane may comprise a urethane prepolymer reacted with a curing agent.

The urethane prepolymer may be obtained by reacting a first polyol compound having two or more hydroxyl groups for each polyol compound molecule with an aromatic polyisocyanate compound having two or more isocyanate groups for each aromatic isocyanate compound molecule.

An equivalence ratio of a hydroxyl group of the first polyol compound to an isocyanate group of the aromatic polyisocyanate compound may be about 1:1.1 to about 1:5.

The first polyol compound is at least one of a polyether-based polyol, a polyester-based polyol, and a polyetherester-based polyol, wherein each of the polyether-based polyol, polyester-based polyol, and polyetherester-based polyol has 2 to 6 hydroxyl groups and a number average molecular weight of about 1000 to about 8000.

The curing agent may include a second polyol compound having two or more hydroxyl groups for each polyol compound molecule.

The curing agent may further include a multifunctional chain extender having two or more of hydroxyl group, amino group, or a combination of these for each multifunctional chain extender molecule, a catalyst capable of catalyzing an addition reaction between an isocyanate end group of the urethane prepolymer compound and a hydroxyl group of the second polyol compound, and a plasticizer.

An equivalence ratio of the isocyanate groups of the urethane prepolymer to a sum of the hydroxyl group of the second polyol compound in the curing agent and the functional groups of the multifunctional chain extender may be about 1:0.5 to about 1:5.0.

Exemplary embodiments of the present general inventive concept also provide a cleaning unit to remove a residual toner from a surface of an electrophotographic photoreceptor, the cleaning unit including a cleaning blade, wherein a rate of the change in a shear modulus value G* of the cleaning blade in MPa over a temperature range of about −5° C. to about 23° C. is between 0.292 and 0.490, and wherein the shear modulus of the cleaning blade at a temperature of −5° C. is between 24.7 MPa and 32.4 MPa.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE EMBODIMENTS

Figure 1:
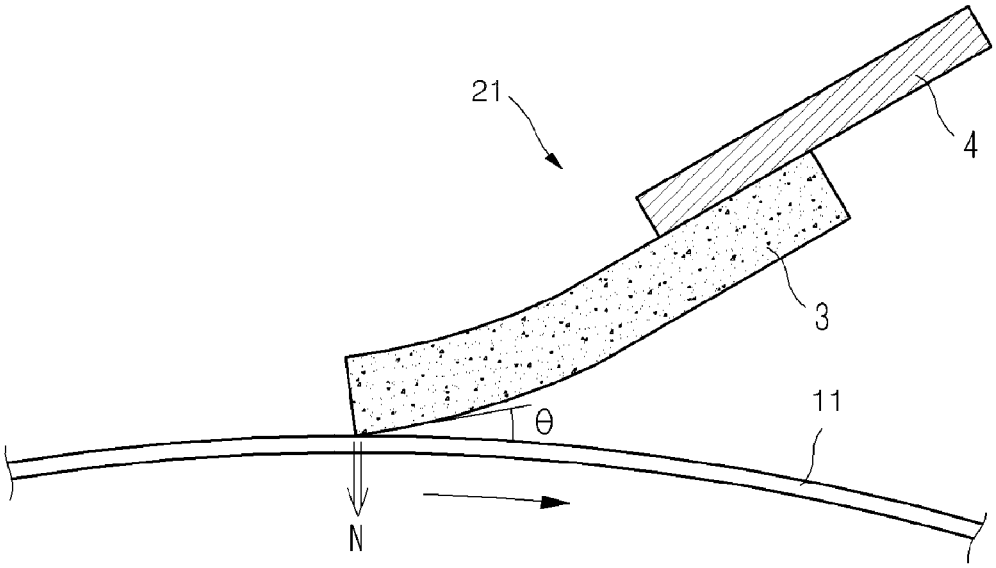
FIG. 1 is a schematic cross-sectional view illustrating a cleaning unit including a cleaning blade according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Hereinafter, an electrophotographic cartridge and an electrophotographic imaging apparatus including a cleaning unit, and a cleaning unit including a cleaning blade according to exemplary embodiments of the present general inventive concept are described more fully.

FIG. 1 is a schematic cross-sectional view illustrating a cleaning unit 21 including a cleaning blade 3 according to an exemplary embodiment of the present general inventive concept.

In reference to FIG. 1, the cleaning unit 21 includes a cleaning blade 3 removing toner and other residues remaining on a surface of an electrophotographic photoreceptor 11 after an image having been transferred and a supporting member 4 supporting the cleaning blade 3 by attaching to at least a part of the cleaning blade 3. A part of the cleaning blade 3 not attached to the supporting member 4 is called a free length of the cleaning blade 3. The toner may be, for example, a styrene-acrylate-based toner or a polyester-based toner. The supporting member 4 is used to support the cleaning blade 3 and may be fixed on a waste toner collector (not illustrated) located at a bottom of the cleaning unit 21 or fixed on a main body (not illustrated) of an electrophotographic imaging apparatus 31 (illustrated in FIG. 2, discussed below). The supporting member 4 may be manufactured using, for example, stainless steel.

The cleaning blade 3 in the cleaning unit 21 applies a blade pressure N on the surface of the electrophotographic photoreceptor 11 and scrapes residues such as residual toner to remove the residues remaining on the electrophotographic photoreceptor 11. Cleaning performance of the cleaning blade 3 may be obtained by increasing the blade pressure N or increasing a cleaning angle θ. However, when the blade pressure is increased, the electrophotographic photoreceptor 11 wears out more quickly and, as a result, a lifespan of the electrophotographic photoreceptor 11 decreases. Accordingly, in consideration of the above properties, the cleaning performance may be maintained by decreasing the blade pressure N while increasing the cleaning angle θ. However, care should be taken because if the cleaning angle θ is too large, the cleaning blade 3 may get rolled up in a rotating direction A of the electrophotographic photoreceptor 11.

The cleaning blade 3 is generally manufactured using a polyurethane. A polyurethane cleaning blade has an advantage of cheap material cost. However, an elasticity of the polyurethane abruptly decreases in a low temperature environment and, as a result, the cleaning performance of the cleaning blade 3 may abruptly decrease in a low temperature environment having a temperature range of about 10° C. to about 20° C. and in a cryogenic environment having a temperature range of about −5° C. to about 0° C. Also, the polyurethane cleaning blade has a sufficient elasticity in a high temperature environment having a temperature range greater than about 20° C., which may lead to an excellent cleaning performance but a poor abrasion resistance and a poor durability, easily resulting in cracks. Specifically, in a high temperature and high humidity environment, rebound resilience of the polyurethane cleaning blade becomes too large during a stick-slip movement such that a restoring force with respect to a rubber strain increases, resulting in cracks and poor cleaning performance.

However, instead of controlling properties of the polyurethane cleaning blade based on tan δ peak value, if the properties of the polyurethane cleaning blade are controlled based on a shear modulus G* value at a specific temperature and a value of the rate of change in the shear modulus G* in MPa over a temperature range ΔT in ° C. (ΔG*(MPa)/ΔT(° C.)) in a specific temperature range, a cleaning blade 3 having excellent cleaning performance in a low temperature environment and excellent abrasion resistance and durability in a high temperature environment may be obtained, resolving problems of the cleaning blade manufactured using a conventional technology.

Shear modulus G* is defined as a square root of a sum of a square of storage modulus(G') and a square of loss modulus (G"), as is well known to a person having ordinary skill in the art: $G^*=(G'^2+G''^2)^{1/2}$.

Hence, the cleaning blade 3 according to an exemplary embodiment of the present general inventive concept is controlled such that its ΔG*(MPa)/ΔT(° C.) value and its shear modulus value at a temperature of −5° C. obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the following conditions (1) and (2): (1) 0.292≤ΔG*(MPa)/ΔT(° C.)≤0.490, (2) 24.7≤G*(MPa)@−5° C.≤32.4, wherein ΔG*(MPa)/ΔT(° C.) is a rate of the change in a shear modulus value G* (unit: MPa) over the change in a temperature range ΔT(° C.) of about −5° C. to about 23° C., and G*(MPa)@−5° C. (unit: MPa) is a shear modulus value at the temperature of −5° C.

If the ΔG*(MPa)/T(° C.) value is less than 0.292, cleaning performance in the low temperature and low humidity environment is good because elasticity is good; however, the abrasion resistance and the durability of the cleaning blade 3 is poor in the high temperature and the high humidity environment, increasing the possibility of cracks in the cleaning blade 3. If the ΔG*(MPa)/ΔT(° C.) value is greater than 0.490, the abrasion resistance and the durability of the cleaning blade 3 is high, decreasing the possibility of cracks in the cleaning blade 3 in the high temperature and high humidity environment; however, the cleaning performance in the low temperature and low humidity condition may be poor because of poor elasticity. If the G*(MPa)@−5° C. value is less than 24.7, the abrasion resistance and the durability of the cleaning blade 3 in the high temperature and high humidity environment may be poor. If the G*(MPa)@−5° C. value is greater than 32.4, then the cleaning performance of the cleaning blade 3 in the low temperature and low humidity environment may be poor. If the cleaning performance of the cleaning blade 3 is poor, the residual toner attaches to a charging roller 13 (illustrated in FIG. 2, discussed below), contaminating the charging roller 13. As a result, a charging property of contaminated surface areas of the charging roller 13 decreases, resulting in a poor imaging quality due to streaks in areas of the printed image corresponding to the contaminated surface areas where the charging property has decreased.

According to another exemplary embodiment of the present general inventive concept, a shear modulus of the cleaning blade 3 at a temperature of 23° C. may further satisfy the condition (3): (3) 9.3≤G*(MPa)@ 23° C.≤14.6, wherein G*(MPa)@23° C. is a shear modulus value (unit: MPa) at the temperature of 23° C.

If the G*(MPa)@23° C. value is less than 9.3, the abrasion resistance and the durability of the cleaning blade 3 may be poor in the high temperature and high humidity environment. If this value is greater than 14.6, cleaning performance may be poor in the low temperature and low humidity environment.

To sum up, the polyurethane cleaning blade 3 satisfying all of the conditions (1), (2), and (3) according to an exemplary embodiment of the present general inventive concept has excellent cleaning performance, abrasion resistance and durability when imaging in a cryogenic environment having a temperature range of about −5° C. to about 0° C. as well as in a high temperature and high humidity environment having a temperature range greater than about 20° C. Hence, according to an exemplary embodiment of the present general inventive concept, a cleaning blade 3 having an excellent cleaning performance in the low temperature and low humidity environment and having an excellent abrasion resistance in the high temperature and high humidity environment may be obtained by preparing the cleaning blade 3 based on G* (shear modulus) design of the polyurethane cleaning blade.

The cleaning blade 3 is prepared by primarily using a polyurethane rubber or a polyurethane elastomer. According to an exemplary embodiment of the present general inventive concept, the cleaning blade 3 is essentially composed of a polyurethane rubber or a polyurethane elastomer.

The polyurethane rubber or the polyurethane elastomer may be obtained by preparing a urethane prepolymer and further reacting the urethane prepolymer with a curing agent.

The urethane prepolymer may be obtained, for example, by reacting a first polyol compound having two or more hydroxyl groups for each polyol compound molecule with an aromatic polyisocyanate compound having two or more isocyanate groups, preferably between two to four or more and preferably between two to three isocyanate groups for each aromatic isocyanate compound molecule. The urethane prepolymer may be prepared, for example, by reacting the first polyol compound and the aromatic polyisocyanate compound, wherein an equivalence ratio of a hydroxyl group of the first polyol compound to an isocyanate group of the aromatic polyisocyanate compound is about 1:1.1 to about 1:5. If the equivalence ratio is less than about 1:1.1, then there may be a problem that the end groups of the urethane prepolymer may be a hydroxyl group, not an isocyanate group, and if the equivalence ratio is greater than 1:5, then there is difficulty in increasing a molecular weight of the urethane prepolymer.

In regards to preparing the urethane prepolymer, a polyether-based polyol, a polyester-based polyol, a polyether-ester-based polyol, or a mixture of these may be used as the first polyol compound, each of which having preferably 2 to 6, more preferably 2 to 5 hydroxyl groups and having a number average molecular weight of about 1,000 to about 8,000. For example, the first polyol compound may be polyether-based polyols, such as polyethylene glycols, polypropylene glycols, polybutylene glycols, and the like, which can be obtained by additionally polymerizing ethylene oxide, propylene oxide, THF (tetrahydrofuran) and the like by, as initiators, using an alcohol compound preferably having two to six, preferably having two to five hydroxyl groups, such as ethylene glycol, glycerol, butanediols, trimethylolpropanes, pentaerythritols, and the like. Furthermore, acrylic-modified polyols, silicone-modified polyols, and the like may be used.

In regards to preparing the urethane prepolymer, usable aromatic polyisocyanate compounds include toluene diisocyanate (TDI), 4,4'-methylene diphenyl diisocyanate (MDI), xylene diisocyanate (XDI), isophorone diisocyanate (IPDI), polymethylene polyphenyl polyisocyanate, and the like. Furthermore, a combination of these or modified products of these may be used. Also, aliphatic diisocyanates such as hexamethylene diisocyanate (HDI) and the like may be used.

If the urethane prepolymers are further reacted with the curing agent, the polyurethane rubbers or the polyurethane elastomers may be obtained.

The curing agent includes a second polyol compound having two or more hydroxyl groups for each polyol compound molecule. The second polyol may be identical to the first polyol. The curing agent may further include a multifunctional chain extender having two or more of hydroxyl group, amino group, or a combination of these for each multifunctional chain extender molecule, a catalyst capable of catalyzing an addition reaction between an isocyanate end group of the urethane prepolymer compound and a hydroxyl group of the second polyol compound, and a plasticizer.

The second polyol compound used in the curing agent may be the same as the first polyol compound used in preparing the polyurethane prepolymers.

A preferable equivalence ratio of the isocyanate groups of the urethane prepolymers to a sum of the hydroxyl group of the second polyol compound in the curing agent and the functional groups of the multifunctional chain extender may be about 1:0.5 to about 1:5.0. If the equivalence ratio is less than 0.5, then there is a problem of an insufficient curing of polyurethane, and if the equivalence ratio is greater than 5.0, then the hardness of the polyurethane may increase.

As the chain extender, water, a multifunctional alcohol having a low molecular weight such as ethylene glycol, 1,2-propanediol, 1,3-propanediol, 1,2-butanediol, 1,3-butanediol, 1,4-butanediol, glycerol, trimethylpropane, and the like and/or a multifunctional polyamine compound such as hydrazine, ethylene diamine, propylene diamine, tetramethylene diamine, pentamethylene diamine, hexamethylene diamine, 1,2-dimethylethylene diamine, 2-methylpentamethylene diamine, diethylenetoluene diamine, 4,4'-diaminodiphenyl ether, 2,3-diaminotoluene, 2,4- or 4,4'-diaminodiphenylmethane, 1,3- or 1,4-diphenyldiamine, naphthalene-1,5-diamine, 1,3-dimethyl-2,4-diaminobenzene, 1,3,5-triethyl-2,4-diaminobenzene, 3,3',5,5'-tetramethyl-4,4'-diaminodiphenylmethane, 3,3'-dimethyl-4,4'-diaminodiphenylmethane, 3,3'-dichloro-4,4'-diaminodiphenylmethane, 4,4'-(1,3-phenyleneisopropylidene)bisaniline, 4,4'-(1,4-phenyleneisopropylidene)bisaniline, and the like may be used, and these may be used alone or in combination of two or more. The amount of the chain extender may be about 0.5 wt % to about 10 wt %, specifically between about 1 wt % to about 5 wt % based on the total weight of the reactants in view of control of a molecular weight of the polyurethane.

As a curing catalyst catalyzing the addition reaction, tin acetate, dibutyl tin acetate, dibutyl tin dilaurate, dioctyl tin dilaurate, tetrabutyl titanate, dibutyl tin maleate, stannous octoate, lead octoate, N,N,N',N'-tetramethyl-1,3-butanediamine, and the like may be used, and these may be used alone or in combination of two or more. The amount of the catalyst used may be about 0.05 wt % to about 5 wt %, specifically about 1 wt % to about 3 wt % based on the total weight of the reactants in view of workability and curing velocity of the curing catalyst.

When reacting the urethane prepolymer with the curing agent, an acid may be used to control a reaction rate by controlling a pH of the reaction system. When mixing the urethane prepolymer and the curing agent, pH may be controlled such that the pH is in a range of about 4 to about 6.5. If the pH is less than 4 or greater than 6.5, the reaction rate may slow down.

As the plasticizer, phthalates such as dibutyl phthalate and dioctyl phthalate, and the like; adipates such as dibutyl adipate and dioctyl adipate and the like; and octoates may be used alone or in combination of two or more. The amount of the plasticizer used may be about 1 wt % to about 10 wt % based on the total weight of the reactants. If the amount of the plasticizer exceeds 10 wt %, durability of the polyurethane may decrease abruptly because of poor mechanical property of the polyurethane.

The cleaning unit according to an exemplary embodiment of the present general inventive concept may integrate into an electrophotographic cartridge 29 or electrophotographic imaging apparatuses 31 (illustrated in FIG. 2, discussed below) such as laser printers, photocopiers, facsimiles, and the like.

Figure 2:
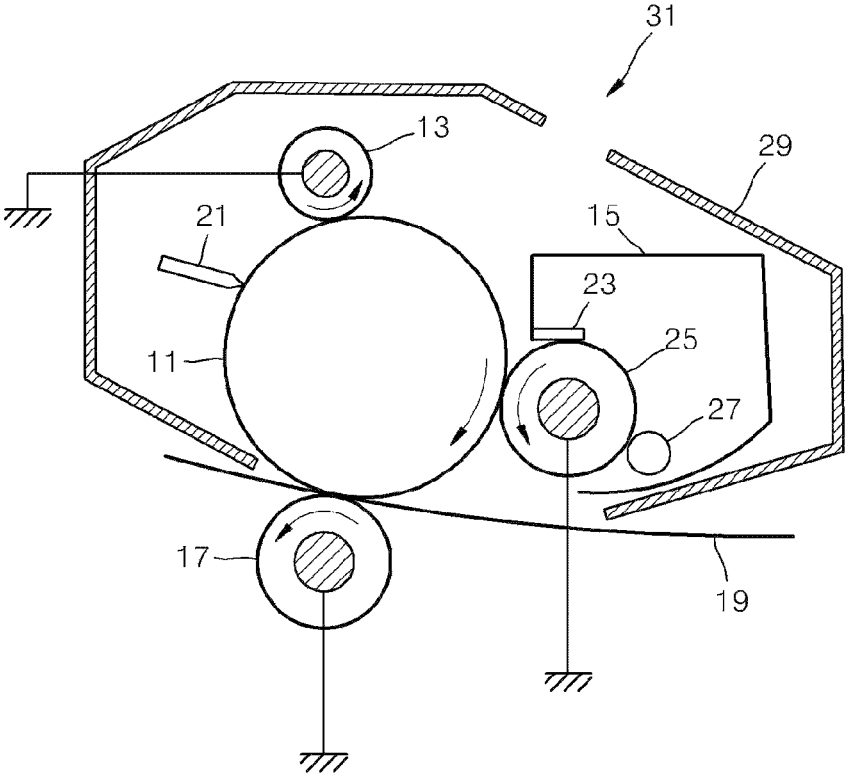
FIG. 2 is a schematic cross-sectional view illustrating an electrophotographic imaging apparatus and an electrophotographic cartridge including a cleaning unit according to an embodiment of the present general inventive concept.

FIG. 2 is a schematic cross-sectional view showing an electrophotographic imaging apparatus 31 and an electrophotographic cartridge 29 including the cleaning unit 21 according to an exemplary embodiment of the present general inventive concept.

The electrophotographic imaging apparatus 31 according to an exemplary embodiment of the present general inventive concept includes an electrophotographic photoreceptor 11; a charging apparatus such as a charging roller 13 charging the electrophotographic photoreceptor 11 by contacting the electrophotographic photoreceptor 1; an exposure apparatus (not illustrated) forming an electrostatic latent image on a surface of the electrophotographic photoreceptor 11; a developing apparatus 15 producing a visible image by developing the electrostatic latent image; a transfer apparatus such as a transfer roller 17 transferring the visible image onto an image-receiving member; and a cleaning unit 21 removing a residual toner present on the surface of the electrophotographic photoreceptor 11, wherein the cleaning unit 21 includes the cleaning blade 3 according to an exemplary embodiment of the present general inventive concept, described above with reference to FIG. 1.

The electrophotographic cartridge 29 includes the electrophotographic photoreceptor 11 and the cleaning unit 21 removing a residual toner present on a surface of the electrophotographic photoreceptor 11 after a visible image formed thereon having been transferred onto an image-receiving member, wherein the electrophotographic cartridge 29 supports the electrophotographic photoreceptor 11 and the cleaning unit 21 and is attachable to and detachable from an electrophotographic imaging apparatus 31.

With reference to FIG. 2, an electrophotographic photoreceptor 11 in the form of a drum is charged by a charging roller 13 contacting the electrophotographic photoreceptor 11. Thereafter, the electrostatic latent image is formed by exposing a laser light (not illustrated) to image portions. Using a developing apparatus 15, the electrostatic latent image is changed into a visible image, for example, to a toned image and the toned image is transferred to an image-receiving member 19 using a transfer roller 17. After the transferring, a residual toner left on a surface of the electrophotographic photoreceptor 11 is removed by a cleaning unit 21, specifically by the cleaning blade 3 according to the exemplary embodiment of the present general inventive concept described above in reference to FIG. 1. The electrophotographic photoreceptor 11 can be provided to be used again to form an image in the next cycle. The developing apparatus 15 includes a toner layer regulating blade 23, a developing roller 25, a toner supplying roller 27, and the like.

The electrophotographic cartridge 29 may integrally support the electrophotographic photoreceptor 11 and, if needed, the charging apparatus 13, the developing apparatus 15, and the cleaning unit 21 according to an exemplary embodiment of the present general inventive concept.

Hereinafter, the present general inventive concept will be described in greater detail according to exemplary embodiments. It should be understood that the exemplary embodiments described herein should be considered in a descriptive sense only and not for purposes of limitation.

Examples 1 to 3 (E 1 to 3) and Comparative Examples 1 to 6 (CE 1 to 6)

Mixtures were obtained by weighing and homogenously mixing urethane prepolymers, which are a main component, and curing agents as shown in Table 1 below, and bubbles formed in the mixtures were removed. Each mixture obtained was immediately inserted into a mold (not illustrated) using centrifugal casting to prepare a cleaning blade and then cured by heating it to a temperature of 150° C. for about 30 minutes to about 45 minutes. A cleaning blade 3 according to an exemplary embodiment of the present general inventive concept or a cleaning blade according to a conventional technology was obtained by taking out a polyurethane rubber cleaning blade from the mold.

TABLE 1

| | Urethane prepolymer main component | | | Curing agent | | |
|---|---|---|---|---|---|---|
| | Ethylene glycol adipate mixing amount (parts by weight) | Polyethylene adipate (Mn = 2,000) mixing amount (parts by weight) | NCO %*** Of the main component | 1,4-butanediol (parts by weight) | Trimethylol propane (parts by weight) | Amine curing agent* (parts by weight) |
| E 1 | 100 | 67 | 10.9% | 7.85 | 4.75 | — |
| E 2 | 100 | 73 | 13.7% | 6.74 | 4.12 | — |
| E 3 | 100 | 79 | 16.9% | 6.52 | 3.95 | trace** |
| CE 1 | 100 | 62 | 13.7% | 6.91 | 4.15 | — |
| CE 2 | 100 | 55 | 13.7% | 5.44 | 3.31 | — |
| CE 3 | 100 | 50 | 13.7% | 5.03 | 3.03 | trace |
| CE 4 | 100 | 82 | 16.4% | 8.42 | 5.14 | — |
| CE 5 | 100 | 79 | 14.5% | 8.36 | 5.06 | — |
| CE 6 | 100 | 76 | 11.7% | 7.78 | 4.88 | trace |

*N,N,N',N'-tetramethyl-1,3-butanediamine,

**less than 300 wt ppm based on the total polyurethane weight,

***isocyanate group % present at end groups of the obtained urethane prepolymer assuming that the total weight of the main component (ethylene adipate + polyethylene adipate + 4,4'-methylene diphenyl diisocyanate) is 100

Cleaning Performance Test

The printer sets employing each of the cleaning blades obtained in Examples 1 to 3 and Comparative Examples 1 to 6 and developing apparatuses were maintained for more than 24 hours in a Climatic Chamber capable of controlling the temperature of the Climatic Chamber to −5° C. Thereafter, confirmation was made to ensure that the temperature of the Climatic Chamber was below −5° C. and cleaning performances corresponding to changing environments were tested as follows under the conditions wherein printer processing speed was at about 108 mm/s to about 343 mm/s (color 4 ppm to 24 ppm), a free length of the cleaning blade of an electrophotographic photoreceptor drum was 7.8 mm, and a thickness of the cleaning blade was 2 mm. First, printer sets were maintained for more than 24 hours and then test images were printed to evaluate printing quality using the printer sets. The printed materials were used to evaluate cleaning performance of the cleaning blade as described below.

◎: Vertical black streaks do not occur in non-image areas of the printed materials.

○: If non-image areas are closely analyzed, vertical black streaks are visible; however, after a continuous printing, the black streaks disappear.

x: At least one vertical black streak appears clearly in non-image areas of the printed materials.

If at least one clear vertical black streak appears in the non-image areas of the printed materials, a surface of a charging roller of the printer set is contaminated.

Abrasion Resistance Test

The printer sets employing each of the cleaning blades obtained in Examples 1 to 3 and Comparative Examples 1 to 6 and developing apparatuses were maintained for more than 24 hours in a Climatic Chamber capable of controlling temperature and humidity to a high temperature and high humidity (H/H) environment (30° C./85% RH). Thereafter, confirmation was made to ensure that the temperature/humidity of the Climatic Chamber was at 30° C./85% RH, and an abrasion resistance corresponding to changing environments was tested as follows under the conditions wherein printer processing speed was at about 108 mm/s to about 343 mm/s (color 4 ppm to 24 ppm), a free length of the cleaning blade of an electrophotographic photoreceptor drum was 7.8 mm, and a thickness of the cleaning blade was 2 mm.

First, the printer sets were maintained for over 24 hours. One page was then printed by using the printer sets under a user environment having a small toner consumption (text printing, 1% coverage), followed by pausing an imaging unit for 37 seconds. The processes of printing a page and pausing the imaging unit were then repeated.

Herein, the abrasion resistance of the cleaning blade was evaluated by counting a number of printed pages without vertical black streaks in non-image areas. As a number of the high quality printed pages increases, print processing time until cracks occur in an edge area of the cleaning blade increases, achieving a long lifespan of the printer set.

Response Factor Test

Rheological properties of ΔG*(MPa)/ΔT(° C.) which is a rate of the change in a shear modulus value G* over the change in a temperature range ΔT(° C.) of about −5° C. to about 23° C., G*(MPa)@−5° C. which is a shear modulus value at the temperature of −5° C., and G*(MPa)@23° C. which is a shear modulus value at the temperature of 23° C. of a cleaning blade obtained in Examples 1 to 3 and Comparative Examples 1 to 6 were measured according to a sine wave oscillation method by using an ARES measuring tool provided with a dynamic mechanical analyzer (DMA) manufactured from the Rheometric Scientific, Inc. under the measuring conditions indicated below:

measuring conditions: temperature range of about −80° C. to about 50° C., frequency: 10 Hz, strain: 0.03%, heating rate: 2° C./min specimen size: 3 mm*60 mm, and grip gap: 20 mm.

Young's Modulus, Modulus, and Elongation at Break Tests

Young's modulus, modulus at each of 100% and 300% of elongation, and elongation at break of the cleaning blades obtained in Examples 1 to 3 and Comparative Examples 1 to 6 were measured by using a Shimadzu EZ-Test L Type Universal Testing Machine (UTM). Dumbbell no. 3 type specimens were used, and the specimens were 2 mm thick. A measuring environment was at a temperature of 23° C. and humidity of 55% RH.

Herein, Young's modulus is a modulus value measured when the specimens were elongated to 5% at a velocity of 10 mm/min. The modulus at an elongation of 100% and the modulus at an elongation of 300% were measured under a condition of elongating the specimen at a velocity of 500 mm/min. The elongation at break is an elongation in which the specimens break while being elongated at a velocity of 500 mm/min.

Rebound Resilience Test

Rebound resilience of the specimens were tested using a Lupke type resilience tester (Model: VR-6500 Series) from SATRA-HAMPDEN according to JIS K 6255 standard under an environment having a temperature of 23±2° C. and a humidity of 50±10% RH. Herein, six layers (12 mm total thickness) of a circular specimen each having a diameter of 30 mm and a thickness of 2 mm were laminated, the laminated product thereof was hit three times using an impact bar, and a measured value of the rebound resilience of the circular specimen was recorded on a fourth hit. The locations of the impact bar were recorded in % after hitting the specimen in which, when the impact bar returns to its initial location, the rebound resilience is recorded as 100%. Rebound resilience of the specimens were also tested under a temperature condition of 10±2° C. and a temperature condition of 55±2° C.

Hardness Test

Hardness of specimens having a thickness of 2 mm were tested by using an IRHD rubber hardness tester from Bareiss GmbH after maintaining the specimens for more than 8 hours in an environment having a temperature of 23±2° C. and a humidity of 50±10% RH.

Test results described above were listed in Table 2 below.

compared to the cleaning blades in Comparative Examples 1 to 6. However, by satisfying a shear modulus property such that the conditions (1), (2), and (3) are satisfied, cleaning performances in the N/N environment and abrasion resistance in the H/H environment have been significantly improved.

The cleaning blade 3 according to the exemplary embodiments of the present general inventive concept has excellent cleaning performance when producing an image under a cryogenic environment and also has excellent abrasion resistance and durability in a high temperature and high humidity environment. In this regard, the electrophotographic cartridge 29 and the electrophotographic imaging apparatus 31 employing the cleaning unit 21 having the cleaning blade 3 according to exemplary embodiments of the present general inventive concept may provide high quality images for a long period of time even when the electrophotographic cartridge 29 and the electrophotographic imaging apparatus 31 are used continuously at a high processing speed under various conditions. Hence, the cleaning blade 3 according to exemplary embodiments of the present general inventive concept may achieve the following effects:

(1) The cleaning blade 3 may efficiently remove a small diameter residual toner, minimizing contamination of members of the electrophotographic photoreceptor 11 and other developing apparatuses. Accordingly, high quality images may be provided for a long period of time under various environmental conditions such as the cryogenic environment and the high temperature and high humidity environment.

(2) A cost of changing the cleaning blade 3, which is a consumable product, may be reduced as a lifespan of the cleaning blade 3 increases.

TABLE 2

| | Hardness | Young's modulus (MPa) | Rebound resilience (%) @ 10° C. | Rebound resilience (%) @ 23° C. | Rebound resilience (%) @ 55° C. | Modulus (MPa) @ 100% | Modulus (MPa) @ 300% | Elongation at break (%) | Cleaning performance @ −5° C. | Cleaning performance @ N/N | Cleaning performance @ H/H | Blade abrasion resistance (Crack) @ N/N | Blade abrasion resistance (Crack) @ H/H |
|---|---|---|---|---|---|---|---|---|---|---|---|---|---|
| E 1 | 79 | 9.8 | 10 | 32 | 54 | 5.7 | 30.2 | 331 | ○ | ◎ | ◎ | >24K | >16K |
| E 2 | 72 | 5.4 | 21 | 33 | 62 | 3.6 | 21.5 | 336 | ◎ | ◎ | ◎ | >24K | >16K |
| E 3 | 78 | 8.1 | 11 | 23 | 68 | 5.4 | 19.6 | 415 | ◎ | ◎ | ◎ | >24K | >16K |
| CE 1 | 83 | 11.6 | 27 | 46 | 73 | 5.1 | 10.9 | 450 | ◎ | Δ | X | 12.4K | 5.2K |
| CE 2 | 78 | 13.1 | 13 | 35 | 64 | 5.1 | 10.0 | 373 | ◎ | ○ | X | >16K | 2.6K |
| CE 3 | 72 | 5.9 | 33 | 49 | 62 | 5.9 | 17.8 | 336 | ◎ | X | X | 7.6K | 6.3K |
| CE 4 | 75 | 7.84 | 11 | 21 | 66 | 4.6 | 22.3 | 305 | X | ○ | ○ | >16K | >16K |
| CE 5 | 71 | 6.77 | 10 | 18 | 63 | 3.5 | 27.5 | 314 | X | ◎ | ◎ | >24K | >16K |
| CE 6 | 76 | 8.52 | 13 | 25 | 68 | 4.7 | 24.9 | 330 | X | ◎ | ○ | >24K | >16K |

| | Response Factor | | |
|---|---|---|---|
| | ΔG * (MPa)/ΔT | G * (MPa) @ −5° C. | G * (MPa) @ 23° C. |
| E 1 | 0.490 | 32.4 | 11.0 |
| E 2 | 0.351 | 24.7 | 9.3 |
| E 3 | 0.292 | 26.9 | 14.6 |
| CE 1 | 0.199 | 16.6 | 7.2 |
| CE 2 | 0.272 | 23.7 | 12.3 |
| CE 3 | 0.098 | 14.2 | 9.2 |
| CE 4 | 0.703 | 42.5 | 12.7 |
| CE 5 | 0.540 | 34.2 | 13.2 |
| CE 6 | 0.632 | 37.2 | 10.3 |

N/N: 23° C., 50~60% RH,
H/H: 30° C., 80% RH

N/N: 23° C., 50-60% RH, H/H: 30° C., 80% RH

In reference to Table 2, the cleaning blades in Examples 1 to 3 according to the present general inventive concept have similar values with respect to hardness, Young's modulus, rebound resilience, modulus, and elongation at break when (3) A CR (Cleanerless) method may be selected, the method not employing a cleaner to clean a cleaning roller (CR).

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A cleaning blade to remove a residual toner present on a surface of an electrophotographic photoreceptor, wherein a value of the shear modulus of the cleaning blade over the change in a temperature range of about −5° C. to about 23° C. and a value of the shear modulus of the cleaning blade at a temperature of −5° C. obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the following conditions:

$$0.292 \leq \Delta G^*(\text{MPa})/\Delta T(^\circ\text{ C.}) \leq 0.490,$$

$$24.7 \leq G^*(\text{MPa})@-5^\circ\text{ C.} \leq 32.4, \text{ and}$$

wherein ΔG*(MPa)/ΔT(° C.) is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

2. The cleaning blade of claim 1, wherein a value of the shear modulus of the cleaning blade at a temperature of 23° C. further satisfies the following condition:

$$9.3 \leq G^*(\text{MPa})@23^\circ\text{ C.} \leq 14.6, \text{ and}$$

wherein G*(MPa)@23° C. is the shear modulus value (unit: MPa) at the temperature of 23° C.

3. The cleaning blade of claim 1, wherein the cleaning blade comprises a polyurethane.

4. A cleaning unit to remove a residual toner present on a surface of an electrophotographic photoreceptor, the unit comprising:

a cleaning blade; and a supporting member to support the cleaning blade by attaching to at least one part of the cleaning blade;

wherein the cleaning blade removes the residual toner present on the surface of the electrophotographic photoreceptor, wherein a value of the shear modulus of the cleaning blade over the change in a temperature range of about −5° C. to about 23° C. and a value of the shear modulus of the cleaning blade at a temperature of −5° C. obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03% satisfy the following conditions:

$$0.292 \leq \Delta G^*(\text{MPa})/\Delta T(^\circ\text{ C.}) \leq 0.490,$$

$$24.7 \leq G^*(\text{MPa})@-5^\circ\text{ C.} \leq 32.4, \text{ and}$$

wherein ΔG*(MPa)/ΔT(° C.) is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

5. The cleaning unit of claim 4, wherein a value of the shear modulus of the cleaning blade at a temperature of 23° C. further satisfies the following condition:

$$9.3 \leq G^*(\text{MPa})@23^\circ\text{ C.} \leq 14.6, \text{ and}$$

wherein G*(MPa)@23° C. is the shear modulus value (unit: MPa) at the temperature of 23° C.

6. The cleaning unit of claim 4, wherein the cleaning blade comprises a polyurethane.

7. An electrophotographic cartridge comprising:

an electrophotographic photoreceptor; and a cleaning unit to remove a residual toner present on a surface of the electrophotographic photoreceptor after a visible image formed thereon having been transferred onto an image-receiving member, wherein the electrophotographic cartridge supports the electrophotographic photoreceptor and the cleaning unit and is attachable to and detachable from an electrophotographic imaging apparatus, wherein the cleaning unit comprises:

a cleaning blade; and a supporting member to support the cleaning blade by attaching to at least one part of the cleaning blade, wherein the cleaning blade removes the residual toner present on the surface of the electrophotographic photoreceptor, wherein a value of the shear modulus of the cleaning blade over the change in a temperature range of about −5° C. to about 23° C. and a value of the shear modulus of the cleaning blade at a temperature of −5° C. obtained from a dynamic viscoelasticity measurement measured as a function of temperature in a temperature range of about −80° C. to about 50° C. under conditions of a frequency of 10 Hz, a heating rate of 2.0° C./min, and an initial strain rate of 0.03%; satisfy the following conditions:

$$0.292 \leq \Delta G^*(\text{MPa})/\Delta T(^\circ\text{ C.}) \leq 0.490,$$

$$24.7 \leq G^*(\text{MPa})@-5^\circ\text{ C.} \leq 32.4, \text{ and}$$

wherein ΔG*(MPa)/ΔT(° C.) is a rate of the change in the shear modulus value G* (unit: MPa) over the change in a temperature range ΔT(° C.) of about −5° C. to about 23° C., and G*(MPa)@−5° C. (unit: MPa) is the shear modulus value at the temperature of −5° C.

8. The electrophotographic cartridge of claim 7, wherein a value of the shear modulus of the cleaning blade at a temperature of 23° C. further satisfies the following condition:

$$9.3 \leq G^*(\text{MPa})@23^\circ\text{ C.} \leq 14.6, \text{ and}$$

wherein G*(MPa)@23° C. is the shear modulus value (unit: MPa) at the temperature of 23° C.

9. The electrophotographic cartridge of claim 7, wherein the cleaning blade comprises a polyurethane.

* * * * *

UNITED STATES PATENT AND TRADEMARK OFFICE

CERTIFICATE OF CORRECTION

PATENT NO. : 9,026,026 B2
APPLICATION NO. : 13/944253
DATED : May 5, 2015
INVENTOR(S) : Soon-cheol Jeong It is certified that error appears in the above-identified patent and that said Letters Patent is hereby corrected as shown below:

In the claims

Claim 6, Column 27, Line 28

Delete “poly isocyanate” and insert --polyisocyanate--, therefor.

Claim 9, Column 28, Line 22 (Approximately)

Delete “mage” and insert --image--, therefor.

Signed and Sealed this
Thirteenth Day of October, 2015

Michelle K. Lee

Michelle K. Lee
*Director of the United States Patent and Trademark Office*